US009972949B1

(12) United States Patent
Stoddard

(10) Patent No.: US 9,972,949 B1
(45) Date of Patent: May 15, 2018

(54) SOLDER-FREE DC CONNECTOR

(71) Applicant: Mark Stoddard, Owasso, OK (US)

(72) Inventor: Mark Stoddard, Owasso, OK (US)

( * ) Notice: Subject to any disclaimer, the term of this patent is extended or adjusted under 35 U.S.C. 154(b) by 17 days.

(21) Appl. No.: 15/466,129

(22) Filed: Mar. 22, 2017

Related U.S. Application Data

(60) Provisional application No. 62/320,956, filed on Apr. 11, 2016.

(51) Int. Cl.

| | |
|---|---|
| ***H01R 9/05*** | (2006.01) |
| ***H01R 24/38*** | (2011.01) |
| ***H01R 13/6592*** | (2011.01) |
| ***H01R 43/28*** | (2006.01) |
| *H01R 103/00* | (2006.01) |

(52) U.S. Cl.
CPC ..... *H01R 24/38* (2013.01); *H01R 13/6592* (2013.01); *H01R 43/28* (2013.01); *H01R 2103/00* (2013.01)

(58) Field of Classification Search
CPC .... H01R 24/38; H01R 13/6592; H01R 43/28; H01R 2103/00
USPC ..... 439/582
See application file for complete search history.

(56) References Cited

U.S. PATENT DOCUMENTS

| | | | | |
|---|---|---|---|---|
| 3,619,702 | A * | 11/1971 | Albrecht | H01J 5/60 313/318.01 |
| 3,954,321 | A * | 5/1976 | Casper | 439/275 |
| 4,316,647 | A * | 2/1982 | Bailey | H01R 13/627 439/354 |
| 4,361,375 | A * | 11/1982 | Bailey | H01R 13/6395 439/352 |
| 5,119,649 | A * | 6/1992 | Spence | B63B 35/7946 114/172 |
| 6,019,622 | A * | 2/2000 | Takahashi | H01R 24/46 200/51.1 |
| 6,430,973 | B1 * | 8/2002 | Huang | B62H 5/003 70/18 |
| 6,477,870 | B1 * | 11/2002 | Derman | E05B 73/0005 70/18 |
| 7,273,394 | B1 * | 9/2007 | English | H01R 24/545 439/582 |
| 2002/0177887 | A1 * | 11/2002 | Krebs | A61B 17/3401 607/115 |
| 2006/0223354 | A1 * | 10/2006 | Hafele | F02P 19/028 439/352 |
| 2011/0039449 | A1 * | 2/2011 | Montena | H01R 9/0524 439/585 |
| 2015/0236458 | A1 * | 8/2015 | Zimmerhaeckel | H01R 24/545 439/582 |

* cited by examiner

*Primary Examiner* — Abdullah Riyami
*Assistant Examiner* — Nader Alhawamdeh
(74) *Attorney, Agent, or Firm* — Head, Johnson, Kachigian & Wilkinson, PC

(57) ABSTRACT

A DC connector that allows a user to insert a coaxial cable and secure it to the connector without the use of soldering. This allows a user to easily customize power cables without soldering, which is particularly desirable for musicians creating custom pedal boards.

11 Claims, 3 Drawing Sheets

SOLDER-FREE DC CONNECTOR

CROSS REFERENCE

This application is based on and claims priority to U.S. Provisional Application No. 62/320,956 filed Apr. 11, 2016.

BACKGROUND OF THE INVENTION

Field of the Invention

This invention relates generally to DC connector, and more particularly, but not by way of limitation, to a modular DC connector that requires no soldering for assembly.

Description of the Related Art

Electrical circuits are often connected via electrical connectors. Such connectors typically join a wire or cable to a terminal or to another wire or cable. When such a connector supplies direct current power, it is known as a DC connector. One example of a typical DC connector is a plug that is permanently attached to a cable and removably inserted into a jack. Power may be provided to the item with the jack via the cable and plug, and then the plug may be removed from the jack when power to the item is no longer desired.

Such a DC connector is typically connected to its associated wire or cable via soldering. This process generally involves stripping any protective coating from the end of the wire or wires; connecting the wires to the appropriate terminals in the connector, generally through bending the wires; applying solder, a heated metal alloy, such as lead or tin, to the wire and terminals to secure the wires to the terminals; and applying a cover or case over the connections. This process is complicated and can be dangerous for a variety of reasons, including the danger of using molten metal, the danger of high heat equipment, and the danger inherent in any endeavor utilizing electricity. Beyond the actual danger, many people perceive greater danger and thus are uncomfortable with soldering and tend to avoid any project that requires soldering.

Notwithstanding the foregoing, building electronic components is a popular activity. This is particularly true in the music industry, where musicians often prefer to assemble their own customized electrical components. For example, guitarists and other musicians often assemble their own pedal boards. Pedal boards allow a guitarist to control certain features of their electric guitar with their feet, by stepping on pedals for particular features. Pedal boards may also be used with other instruments, both electric and acoustic, and even microphones. Given the wide variety of effects and uses of pedals, any given musician may have drastically different pedal board needs than any other musician. Thus, customization is crucial. To this end, pedal boards are often modular, allowing the musician to select which pedals to include and to design their own unique layout.

Typically, each pedal connects to the next pedal, to the pedal board, or to the instrument via an instrument cable with a connector. Depending on the user's needs and the layout of the pedal board, any given instrument cable may need to be a particular type or length. To facilitate the customization of pedal boards, a system of solder-free plugs and instrument cables has been developed to allow a user to select an appropriate type and length of instrument cable and attach a connector to each end without the need for soldering. The user may then use the instrument cable to connect a pedal as desired.

Each pedal also requires a power supply, typically a DC cable plugged into a jack in the pedal. DC cables, however, are not similarly customizable without soldering, as described above. Musicians who are uncomfortable with soldering have thus heretofore had to use standard DC power cords, which often are not long enough, necessitating the use of extension cords, or are too long, leaving excess cable lying around the pedal board, which is unsightly and a trip hazard.

Based on the foregoing, it is desirable to provide a DC connector that may be connected to a wire or cable without the necessity of soldering.

SUMMARY OF THE INVENTION

In general, in a first aspect, the invention relates to a connector comprising a plug sleeve and a cap. The interior of the plug sleeve may have a positive contact, such as a threaded hole or a needle. The interior of the plug sleeve may likewise have a negative contact, such as the interior wall of the plug sleeve. The cap may have an open end that fits over one end of the plug sleeve and an opening through which a cable may pass. The exterior of the plug sleeve may be threaded and the interior of the cap may be correspondingly threaded, such that the cap may be secured to the plug sleeve via the threads.

During use, an end of a coaxial cable may be stripped and the end may be placed through the cap and into the plug sleeve. The stripped end may be placed into contact with the positive contact, but may not be soldered into place. The open end of the cap may be placed over the plug sleeve and the threads may be engaged, thus securing the cap to the plug sleeve.

Figure 1:
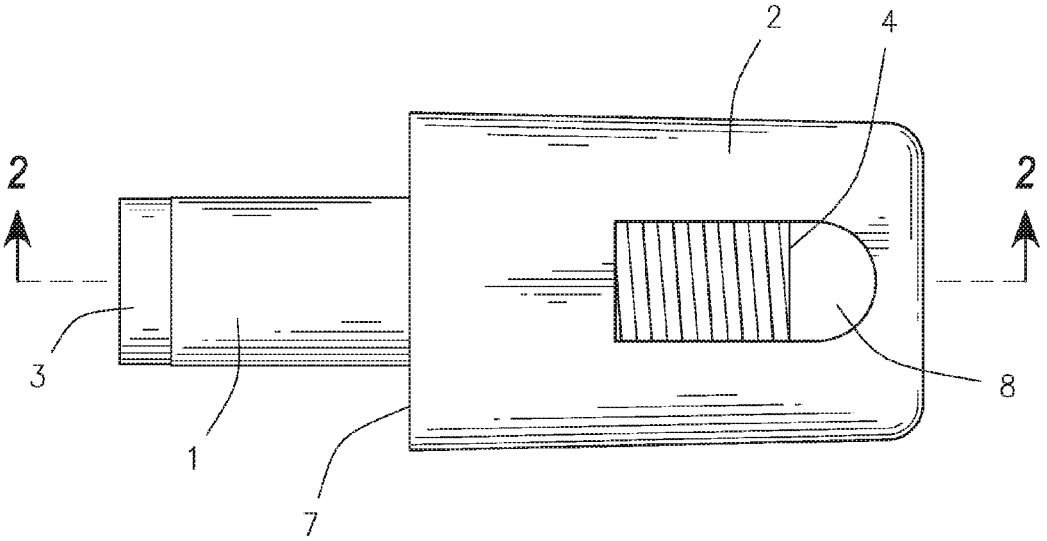
FIG. 1 is a side view of the connector.
Figure 2:
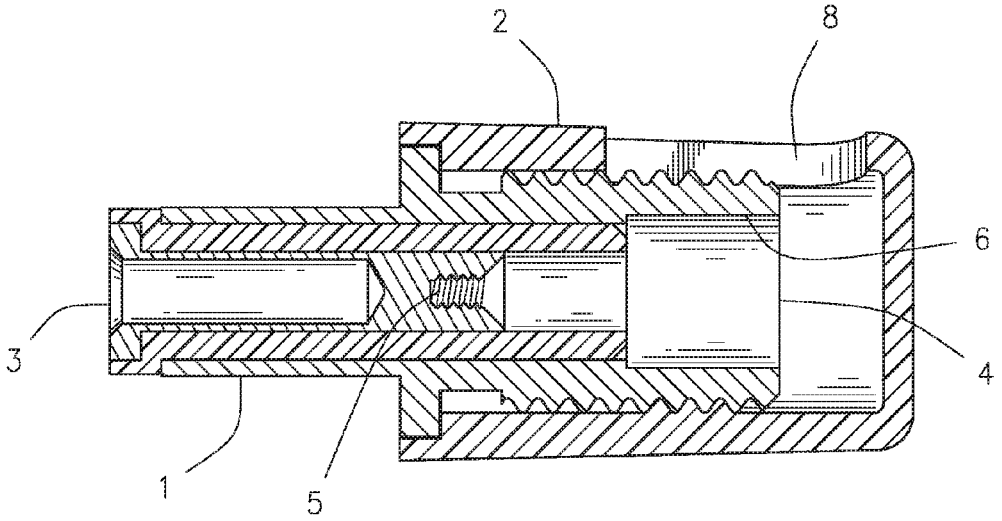
FIG. 2 is a sectional side view of the connector with the positive contact shown as a threaded hole.
Figure 3:
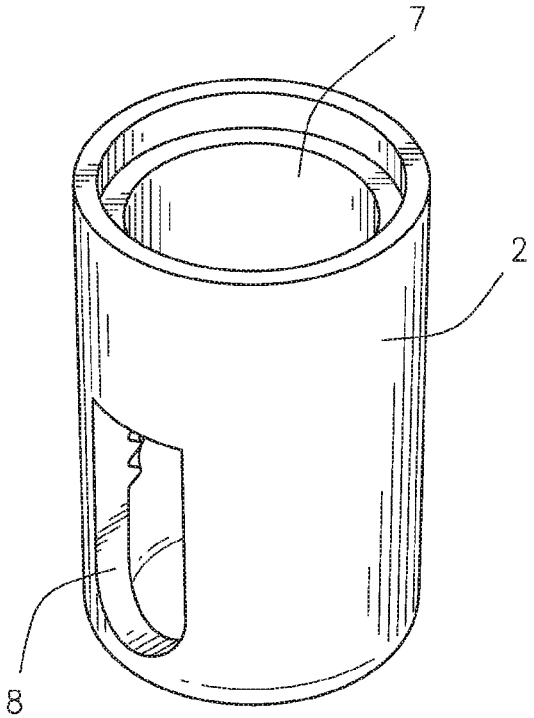
FIG. 3 is a perspective view of the cap.
Figure 4:
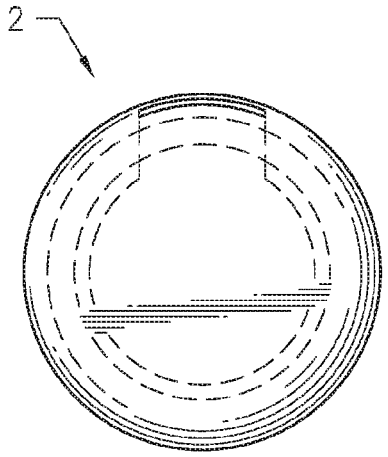
FIG. 4 is a bottom view of the cap.
Figure 5:
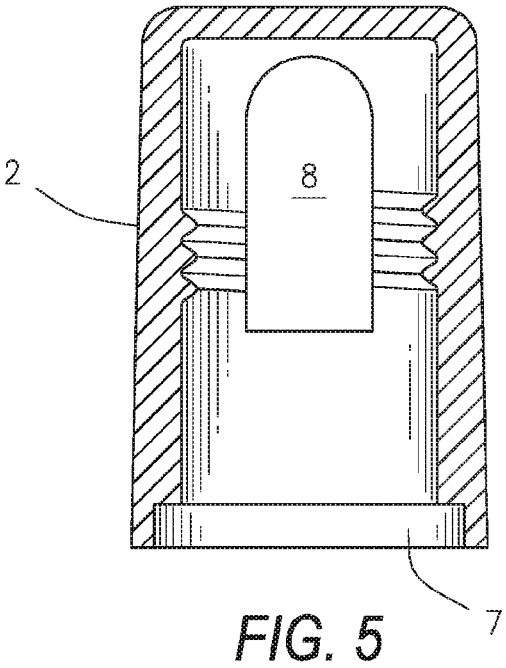
FIG. 5 is a sectional side view of the cap.
Figure 6:
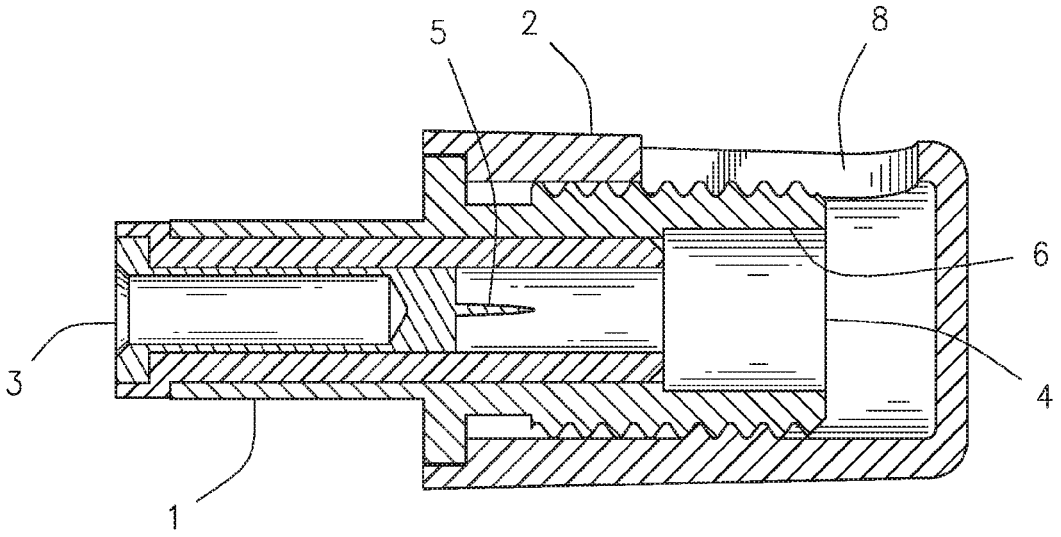
FIG. 6 is a sectional side view of the connector with the positive contact shown as a needle.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a DC connector that can be connected to a cable without soldering. The connector may be a cylindrical connector, such as a 2.1 mm miniature direct current power plug, as shown, or any other standard DC connector and may fit within a corresponding jack or socket. The connector may be used with any desired cable, such as a 20, 22, 24, or 26 AWG coaxial cable.

The connector may comprise a plug sleeve 1 and a cap 2. The plug sleeve 1 may have a first end 3 with a finger insulator, where the first end 3 may be plugged into a corresponding jack or socket. The plug sleeve 1 may have a second end 4, where the second end 4 is open. The cap 2 may fit over the second end 4 of the plug sleeve 1.

A positive contact 5 may be interior of the plug sleeve 1. The positive contact 5 may be a threaded hole, as shown, a needle, or other positive contact. The plug sleeve 1 may have an interior wall 6, which may function as a negative contact.

The cap 2 may have an open end 7, which may fit over the second end 4 of the plug sleeve 1. The cap 2 may have an opening 8 for the cable to pass through. The connector may be a right angle connector, in which case the opening 8 may be in the side of the cap 2 such that the cable must turn at a right angle to pass through the open end 7 and through the opening 8. If the opening 8 is in the side of the cap 2, the opening 8 may be slot, as shown. If the opening 8 is in the side of the cap 2, the end opposing the open end 7 may be closed. Alternately, the connector may be a straight connector, in which case the opening 8 may be opposed to the open end 7 such that the cable may remain straight while passing through the open end 7 and the opening 8. The opening 8 may be a hole rather than a slot.

The exterior of the plug sleeve 1 may be threaded, and the interior of the cap 2 may be correspondingly threaded.

During use, the end of the cable may be stripped and inserted into the plug sleeve 1. If the opening 8 in the cap 2 is a hole rather than a slot, the cable may first be threaded through the cap 2 by inserting the cable into the opening 8 and out of the open end 7. If the positive contact 5 is a threaded hole, the stripped cable may be inserted into the threaded hole. The open end 7 of the cap 2 may then be placed over the second end 4 of the plug sleeve 1, with the cable extending through the opening 8 and then into the plug sleeve 1. The cap 2 may be turned to mate the corresponding threads on the second end 4 of the plug sleeve 1 and the interior of the open end 7 of the cap 2, thus securing the cap 2 to the plug sleeve 1. The first end 3 of the plug sleeve 1 may then be inserted into a corresponding jack and direct current power may be provided through the cable and the connector, and into the jack. The cable may not be soldered to any part of the connector. The process may be reversed to disassemble the connector and remove the cable therefrom.

The connector may have an electrical current carrying ability of five amps.

The plug sleeve may be nickel plated brass alloy, while the finger insulator may be molded plastic. The cap may be nickel plated, anodized brass alloy, or molded plastic. The connector may further comprise a pin and lock ring, which may be nickel plated brass alloy. The connector may further comprise insulating washers, which may be rigid plastic. Alternately, any of the foregoing elements may be any desired material or combination of materials.

Whereas, the devices and methods have been described in relation to the drawings and claims, it should be understood that other and further modifications, apart from those shown or suggested herein, may be made within the spirit and scope of this invention.

What is claimed is:

1. A DC power connector comprising:
a plug sleeve comprising:
a first end capable of plugging into a jack; and
a second end capable of receiving a cable,
such that direct current power is capable of flowing from the cable, through the connector, and into the jack; and
a cap, where:
the plug sleeve has an exterior;
at least a portion of the exterior of the plug sleeve is threaded;
the cap has an interior;
at least a portion of the interior of the cap is threaded; and
the threaded portion of the interior of the cap corresponds to the threaded portion of the exterior of the plug sleeve such that the cap may be secured to the plug sleeve via threading the threaded portions together;
where the connector is capable of being assembled without soldering.

2. The connector of claim 1 where the plug sleeve comprises a positive contact 2 and a negative contact.

3. The connector of claim 2 where the positive contact is a threaded hole located inside the plug sleeve.

4. The connector of claim 2 where the negative contact is an interior wall of the plug sleeve.

5. The connector of claim 1 where: the plug sleeve comprises: a first end capable of being plugged into a corresponding jack or socket; and an opposing second end, where the second end is open; and the cap covers the second end of the plug sleeve and has an opening such that a cable may pass through the opening and into the second end of the plug sleeve with the cap in place on the plug sleeve.

6. The connector of claim 5 where the opening is in a side of the cap.

7. The connector of claim 5 where the opening is in an end of the cap.

8. A method of connecting a DC power connector to a cable, the DC power connector comprising:
a plug sleeve comprising:
a first end capable of plugging into a jack; and
a second end capable of receiving a cable,
such that direct current power is capable of flowing from the cable, through the connector, and into the jack; and
a cap, where:
the plug sleeve has an exterior;
at least a portion of the exterior of the plug sleeve is threaded;
the cap has an interior;
at least a portion of the interior of the cap is threaded; and
the threaded portion of the interior of the cap corresponds to the threaded portion of the exterior of the plug sleeve such that the cap may be secured to the plug sleeve via threading the threaded portions together;
the method comprising:
stripping an end of the cable; and
inserting the stripped end of the cable into the second end of the plug sleeve;
where the method does not comprise soldering.

9. The method of claim 8, the method further comprising placing the cap over the second end of the plug sleeve.

10. The method of claim 9 where the plug sleeve comprises a positive contact interior to the plug sleeve and where inserting the stripped end of the cable into the open end of the plug sleeve comprises inserting the stripped end of the cable into the positive contact.

11. The method of claim 9 where the cap has an opening, the method further comprising passing the stripped end of the cable through the opening in the cap prior to inserting the stripped end of the cable into the open end of the plug sleeve.

* * * * *